US011318629B2

(12) United States Patent
Godlieb et al.

(10) Patent No.: US 11,318,629 B2
(45) Date of Patent: May 3, 2022

(54) SHAVING ASSEMBLY AND HAIR CUTTING APPLIANCE

(71) Applicant: KONINKLIJKE PHILIPS N.V., Eindhoven (NL)

(72) Inventors: Robert Godlieb, Drachten (NL); Johannes Tseard Van Der Kooi, Munein (NL); Martinus Bernardus Stapelbroek, Frieschepalen (NL); Albert Jan Aitink, Drachten (NL); Everhardus Johannes Hoexum, Groningen (NL); Ramachandra Rao Ganesh, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/981,337

(22) PCT Filed: Mar. 19, 2019

(86) PCT No.: PCT/EP2019/056755
§ 371 (c)(1),
(2) Date: Sep. 16, 2020

(87) PCT Pub. No.: WO2019/179969
PCT Pub. Date: Sep. 26, 2019

(65) Prior Publication Data

US 2021/0008742 A1 Jan. 14, 2021

(30) Foreign Application Priority Data

Mar. 23, 2018 (CN) ..... 201820400745.0
May 11, 2018 (EP) ..... 18171816

(51) Int. Cl.
*B26B 19/38* (2006.01)
*B26B 19/06* (2006.01)

(52) U.S. Cl.
CPC ..... *B26B 19/3846* (2013.01); *B26B 19/06* (2013.01)

(58) Field of Classification Search
None
See application file for complete search history.

(56) References Cited

U.S. PATENT DOCUMENTS 2,102,529 A 12/1937 Hanley
2,151,965 A 3/1939 Hanley
(Continued)

FOREIGN PATENT DOCUMENTS

CN 104669317 A 6/2015
CN 106346519 1/2017
(Continued)

OTHER PUBLICATIONS

International Search Report and Written Opinion dated Jun. 28, 2019 for International Application No. PCT/EP2019/056755 filed Mar. 19, 2019.

*Primary Examiner* — Hwei-Siu C Payer

(57) ABSTRACT

Embodiments of present disclosure relates to a shaving assembly and a hair cutting appliance comprising the shaving assembly. The shaving assembly comprises: a supporting arm extending in a first direction; a cutting element comprising at least one moving tooth arranged along the first direction; a guard foil extending in the first direction and surrounding the cutting element, the guard foil comprising: a contact surface and a bent part, wherein an angle between the contact surface and the supporting arm is an acute angle, and at least one guard tooth slot is formed across the contact surface and the supporting arm, wherein the shaving assembly further comprises: a blocking member extending between the moving tooth and the supporting arm in a second direction that is substantially perpendicular to the contact surface, wherein the blocking member is adapted to
(Continued)

facilitate hair being released from the guard tooth slot when the guard tooth slot is moved against the hair.

12 Claims, 7 Drawing Sheets

(56) References Cited

U.S. PATENT DOCUMENTS

| | | | | |
|---|---|---|---|---|
| 2,249,825 | A * | 7/1941 | Hanley | B26B 19/042 30/43.92 |
| 2,290,326 | A | 7/1942 | Hanley | |
| 2,948,063 | A | 8/1960 | Ivar | |
| 3,201,178 | A | 8/1965 | Masashi | |
| 3,203,090 | A | 8/1965 | Ivar | |
| 2017/0050326 | A1 | 2/2017 | Lau | |
| 2017/0246751 | A1 | 8/2017 | Vredeveld | |
| 2018/0099427 | A1* | 4/2018 | Huisman | B26B 19/3846 |
| 2018/0257248 | A1* | 9/2018 | Wu | B26B 19/3846 |
| 2020/0164533 | A1* | 5/2020 | Phoon | B26B 19/12 |
| 2020/0316794 | A1* | 10/2020 | Phoon | B26B 19/06 |
| 2020/0331157 | A1* | 10/2020 | Godlieb | B26B 19/3846 |
| 2021/0008742 | A1* | 1/2021 | Godlieb | B26B 19/3846 |
| 2021/0347069 | A1* | 11/2021 | Roder | B26B 19/3846 |

FOREIGN PATENT DOCUMENTS

| | | | |
|---|---|---|---|
| DE | 2026509 | | 12/1970 |
| EP | 3 566 830 | A1 * | 11/2019 |
| WO | WO 2016/173846 | A1 * | 11/2016 |
| WO | 2018/068353 | | 4/2018 |

* cited by examiner

SHAVING ASSEMBLY AND HAIR CUTTING APPLIANCE

CROSS REFERENCE TO RELATED APPLICATIONS

This application is the U.S. National Phase application under 35 U.S.C. § 371 of International Application No. PCT/EP2019/056755 filed Mar. 19, 2019, which claims the benefit of European Patent Application Number 18171816.4 filed May 11, 2018 and Patent Application Number 201820400745.0 filed Mar. 23, 2018. These applications are hereby incorporated by reference herein.

FIELD OF THE INVENTION

Embodiments of present disclosure generally relate to home appliance, and more specifically, to a shaving assembly and a hair cutting appliance comprising the shaving assembly.

BACKGROUND OF THE INVENTION

Conventional trimmers or clippers for shaving and grooming facial hairs are designed to cut the hairs at a certain distance from the skin. Some close shaving trimmers have been proposed to use a modified construction to enable hair cutting at a much closer distance from the skin. Normally, close shaving trimmers relies on thinner guard-teeth. Further, for achieving an effective and comfortable trim, complex rounding features and other features may also be needed.

As an example, CN106346519A discloses an appliance where a thin and flat metal sheet with guard teeth or hair-catching cut-outs is stretched over a molded base. This type of appliance is usually cheaper as it can be simply constructed from a flat sheet of thin foil. However, such an appliance usually leads to clogging of cut hair at the angulated guard tooth slots. Such clogging issue may especially be caused by relatively long hairs being stuck or wedged in the tilted portion of the slot. In this case, the catching of subsequent hairs will be hindered or even completely stopped.

SUMMARY OF THE INVENTION

Embodiments of the present disclosure provide a shaving assembly with an anti-clogging blocking member and a hair cutting appliance comprising the shaving assembly.

In first aspect, a shaving assembly is provided. The shaving assembly comprises: a supporting arm extending in a first direction; a cutting element comprising at least one moving tooth arranged along the first direction; a guard foil extending in the first direction and surrounding the cutting element, the guard foil comprising: a contact surface and a bent part, wherein the contact surface is adapted to be in contact with skin, and the bent part extends in the first direction for fixing the guard foil on the supporting arm, and wherein an angle between the contact surface and the supporting arm is an acute angle, and at least one guard tooth slot formed across the contact surface and the supporting arm and arranged along the first direction, wherein the guard tooth slot is adapted to direct hair to the moving tooth when the guard tooth slot is moved against the hair, wherein the shaving assembly further comprises: a blocking member extending between the moving tooth and the supporting arm in a second direction that is substantially perpendicular to the contact surface, wherein the blocking member is adapted to facilitate hair being released from the guard tooth slot when the guard tooth slot is moved against the hair.

According to embodiments of the present disclosure, the blocking element can effectively push or eject the cut hairs out of the tooth slot, which reduces the possibility of the hair clogging occurring at the guard tooth slots, thereby enabling a continuous and comfortable shaving.

In some embodiments, the supporting arm comprises at least one groove arranged along the first direction and corresponding to the at least one guard tooth slot, wherein an end of the guard tooth slot extends to a bottom of the groove and an opposite end of the guard tooth slot extends to the moving tooth. In this way, the hairs, especially long hairs, can be easily received at the cutting position of the moving teeth in a substantially vertical orientation.

In some embodiments, the blocking member comprises a first blocking part extending between the moving tooth and the supporting arm in the second direction and comprising a surface facing the guard tooth slot. In these embodiments, the first blocking part may apply an additional force via the surface to push the cut hair out of the slot, when the guard tooth slot is moved against the hair. In this case, the release of the stuck hair no longer just relies on the force applied by the subsequent hair. In this way, the hair can be easily released from the slots.

In some embodiments, an end of the first blocking part is connected to a root associated with the moving tooth, and an opposite end of the first blocking part is separated from an inner wall of the supporting arm by a first distance. In this way, the maintained first distance can reduce the friction generated between the opposite end of the first blocking part and the inner wall of the supporting arm during the movement of the moving tooth.

In some embodiments, the blocking member further comprises at least one second blocking part extending between the moving tooth and the supporting arm in the second direction, wherein the second blocking part is oriented substantially perpendicular to the first blocking part. In some embodiments, the at least one second blocking part comprises two second blocking parts arranged at different sides of the first blocking part. The second blocking parts additionally provide two side walls, which help to maintain the orientation of the cut hair by limiting the movement freedom of the cut hair, in the first direction. In this way, the cut hair can be properly manipulated by the side walls before it is released out of the slot.

In some embodiments, an end of the second blocking part is connected to the moving tooth and an opposite end of the second blocking part is separated from an inner wall of the supporting arm by a second distance. In this way, the maintained second distance likewise can reduce the friction generated between the opposite end of the second blocking part and the inner wall of the supporting arm during the movement of the moving tooth.

In some embodiments, the opposite end of the second blocking part has a surface matching with an inner wall of the supporting arm. In this way, the almost entire inner space defined by an angulated portion can be filled with the second blocking part, which further decreases hair clogging possibility In some embodiments, the surface extends along the inner wall of the supporting arm and beyond a bottom of a groove of the supporting arm, the groove corresponding to the guard tooth slot. In this way, the cut hair can be continuously manipulated by the side walls before it is completely released out of the slot.

In some embodiments, an end of the first blocking part is connected to a bottom of a groove of the supporting arm, the groove corresponding to the guard tooth slot, and an opposite end of the first blocking part is separated from the moving tooth by a third distance. In some embodiments, an end of the second blocking part is connected to a finger associated with a groove of the supporting arm, the groove corresponding to the guard tooth slot, and an opposite end of the second blocking part is separated from the moving tooth by a fourth distance. In this alternative way, the blocking member can be connected to the supporting arm, instead of the moving tooth, which reduces the weight of the moving tooth. Meanwhile, the original design of the cutting element will be not affected.

In some embodiments, the blocking member is integrally formed with the moving tooth.

In some prefered embodiments the remaining gap between the blocking member formed with the moving tooth and the supporting arm should be as small as possible while maintaining sufficient clearance to prevent friction between the blocking member and the support arm. In further prefered embodiments this distance is less than 100 micron, in even more prefered embodiments this distance is less than 50 micron.

In some embodiments, the blocking member is integrally formed with the supporting arm.

In some prefered embodiments the remaining gap between the blocking member formed with the supporting arm and the moving teeth should be as small as possible while maintaining sufficient clearance to prevent friction between the blocking member and the moving teeth. In further prefered embodiments this distance is less than 100 micron, in even more prefered embodiments this distance is less than 50 micron.

An integrally formed blocking member (either integrated with the moving tooth or integrated with the supporting arm) may ease the fabrication and assembly of the shaving assembly, and meanwhile improving the overall stiffness.

In second aspect, a hair cutting appliance is provided. The hair cutting appliance comprises: a shaving assembly according to the first aspect of the present disclosure; and a driving mechanism configured to cause a movement of the cutting element inside the shaving assembly.

Through the following discussions, it would be apparent that compared to conventional hair cutting appliance, the hair cutting appliance comprising the anti-clogging shaving assembly according to various embodiments of present disclosure avoids the hair clogging occurring at the slots, and thereby the discomfort and discontinuousness occurred during the user's shaving can be eliminated. Meanwhile, the simple design and easy fabrication makes such cutting appliance cost-effective.

BRIEF DESCRIPTION OF THE DRAWINGS

Drawings described herein are provided to further explain the present disclosure and constitute a part of the present disclosure. The example embodiments of the disclosure and the explanation thereof are used to explain the present disclosure, rather than to limit the present disclosure improperly.

Throughout the drawings, the same or similar reference symbols are used to indicate the same or similar elements.

DETAILED DESCRIPTION OF THE EMBODIMENTS

Figure 1A:
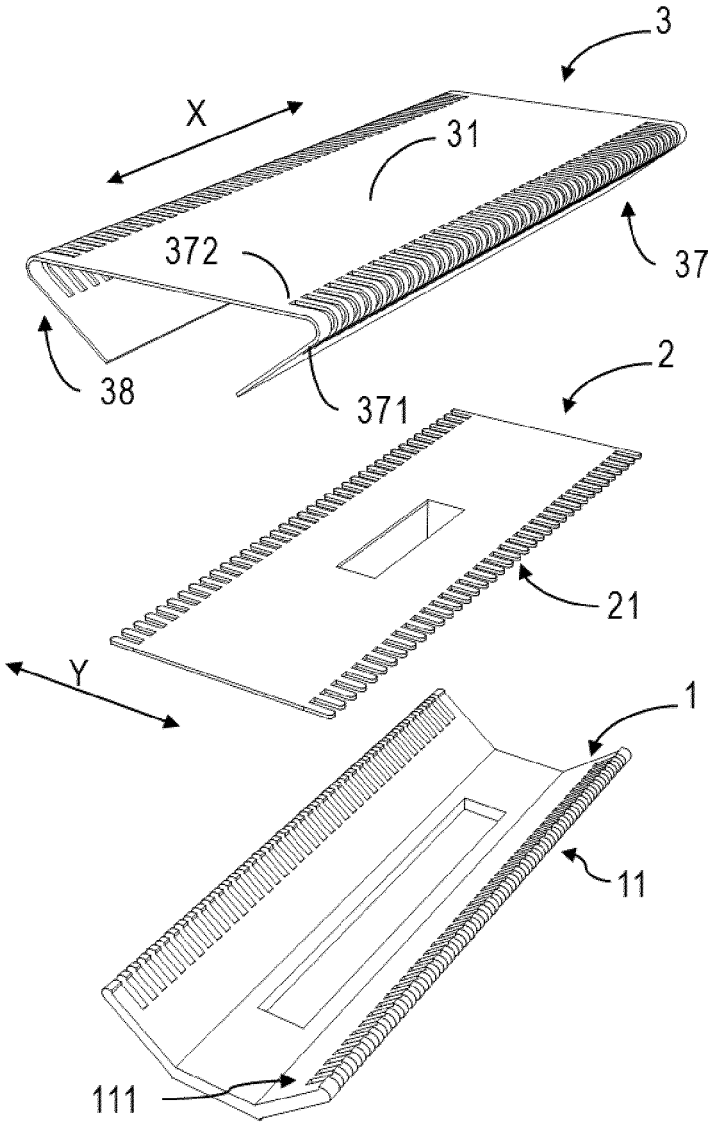
FIG. 1A illustrates an exploded view of an a shaving assembly in accordance with various embodiments of the present disclosure, with no blocking member attached.

Principles of the present disclosure will now be described with reference to several example embodiments shown in the drawings. Though example embodiments of the present disclosure are illustrated in the drawings, it is to be understood that the embodiments are described only to facilitate those skilled in the art in better understanding and thereby achieving the present disclosure, rather than to limit the scope of the disclosure in any manner.

FIG. 1A illustrates an exploded view of a shaving assembly 100 according to various embodiments of the present disclosure. As shown, the shaving assembly 100 generally comprises a guard foil 3, a cutting element 2, and a base comprising two supporting arms 1.

For sake of discussions, in the following, the length direction of the shaving assembly 100 is referred to a "first direction" X, the height direction of the shaving assembly 100 is referred to a "second direction" Z, and the width direction of the shaving assembly 100 is referred to a "third direction" Y. The first direction X and the third direction Y are perpendicular to each other and jointly define a horizontal plane XY. The second direction Z is substantially perpendicular to the horizontal plane XY.

The two supporting arms 1 extend in the first direction X and are tilted with respect to the third direction Y by a certain angle. The cutting element 2 also extends in a first direction X and comprises multiple moving teeth 21 that are arranged along the first direction X. Further, in some embodiments, the guard foil 3 can be stretched to surround the cutting element 2 via a bend of a part of the guard foil 3 with respect to an axis along the first direction X.

Figure 1B:
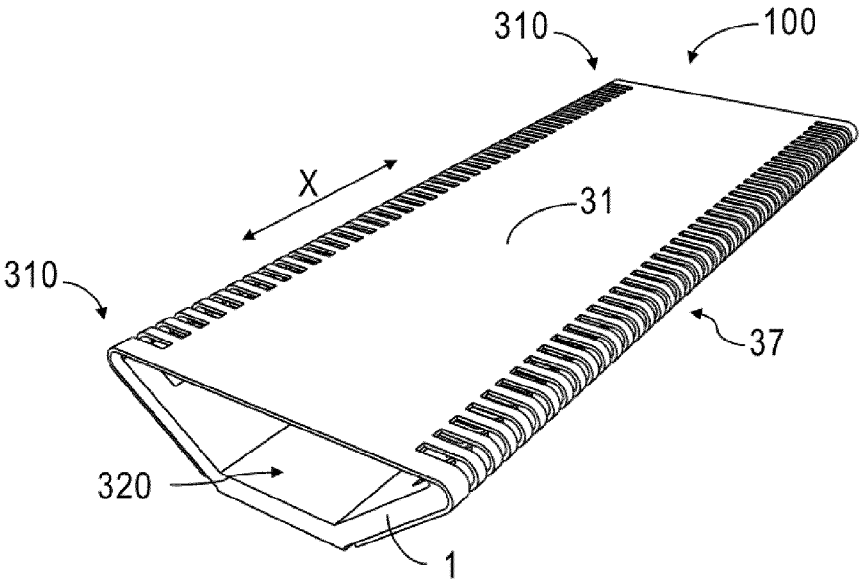
FIG. 1B illustrates a perspective view of the shaving assembly as shown in FIG. 1A in an assembled state.
Figure 1C:
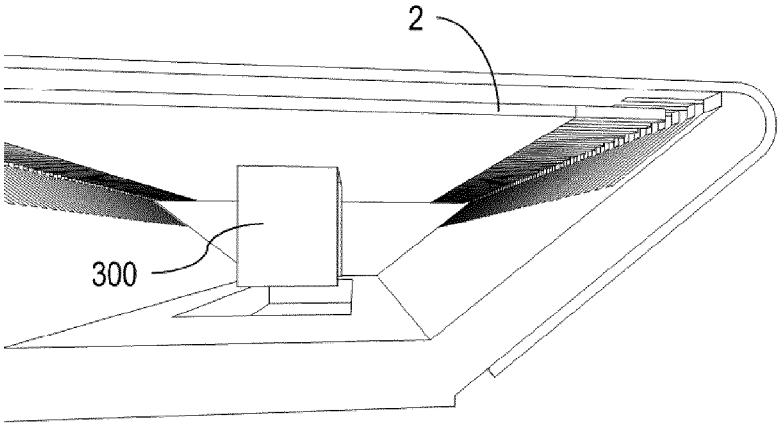
FIG. 1C illustrates another perspective view of the shaving assembly as shown in FIG. 1B.

As illustrated in FIGS. 1A-1C, the guard foil 3 comprises a contact surface 31 and a bent part 38. When operated, the contact surface 31 is adapted to be in contact with skin of a user, and the bent part 38 extends in the first direction X for fixing the guard foil 3 on the supporting arm 1. In this way, the guard foil 3 can be supported or suspended on the supporting arm 1, thereby forming an inner space 320 of the shaving assembly 100 as illustrated in FIG. 1B. The inner space 320 can be used to accommodate the driving mechanism 300 for causing the movement of the cutting element 2, as illustrated in FIG. 1C.

In some embodiments, the contact surface 31 may be substantially flat. In some other embodiments, the contact surface 31 may include some additional surface features (such as, curved features) to enhance the shaving comfort. In some other embodiments, the whole contact surface may be even constructed as a curved surface to meet some specific requirements.

Still with reference to FIG. 1A, according to embodiments of the present disclosure, multiple guard tooth slots 37 are arranged along the first direction X. The guard tooth slots 37 are formed across both the contact surface 31 and the supporting arm 1. In other words, those guard tooth slots 37 are formed at the corner or angulated part that is formed by the contact surface 31 and the supporting arm 1. Those guard tooth slots 37 correspond to the moving teeth 21 and can be used to direct hair to the moving teeth 21 when the guard tooth slot 37 is moved against the hair during the operation.

In some embodiments, as illustrated in FIG. 1A, the supporting arm 1 may comprise multiple grooves 11. Those grooves 11 are likewise arranged along the first direction X and corresponding to the guard tooth slots 37. In this example, one end 371 of the guard tooth slot 37 extends to a bottom 111 of the groove 11, and the opposite end 372 of the guard tooth slot 37 extends to the moving tooth 21. Thereby, an angulated guard tooth slot 37 is formed. In this way, the hairs, especially long hairs, can be easily guided into the slots 37 to arrive at the cutting position of the moving teeth 21 in a substantially vertical orientation, or in other words, in the second direction Z).

Figure 2:
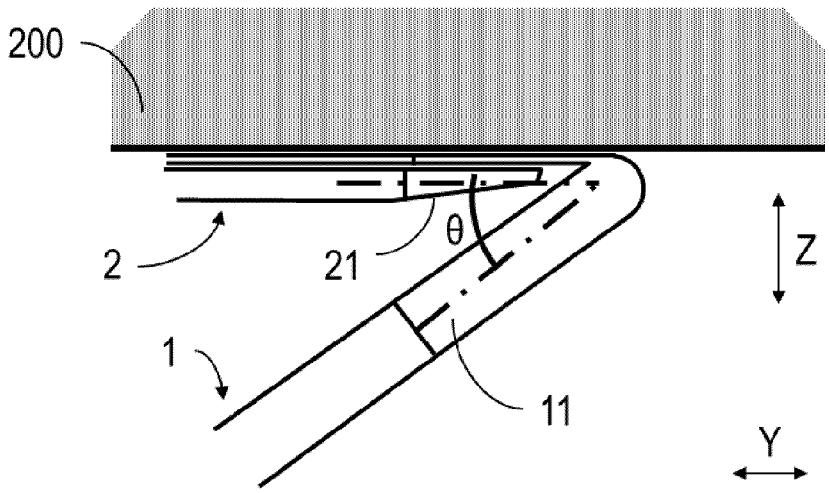
FIG. 2 illustrates a side view of the shaving assembly of FIG. 1C.

Referring to FIG. 2, as discussed above, due to the tilted orientation of the supporting arm 1, when the guard foil 3 is fixed on the supporting arms 1, an acute angle 0 is formed between the contact surface 31 of the guard foil 3 and the supporting arm 1. The inventors have found that in association with the structure of the shaving assembly 100, a potential clogging may occur at the angulated guard tooth slots 37, and especially at the tilted portion of the guard tooth slot 37 attached along the supporting arm 1.

This is in part because the angulated guard tooth slots 37 will increase the possibility that the long hair is stuck or wedged at the tilted portion of the guard tooth slots 37. In addition, the dimension of the slot along the first direction X is normally designed to be in the same order of the diameter of a hair to enable an effective cutting, which also attributes to the hair wedge. Moreover, especially when the guard foil 3 is fixed on the supporting arm 1, and thus the guard tooth slot 37 is aligned with the relative thick groove 11, a thick slot is formed, which also attributes to the hair wedge.

Figure 3C:
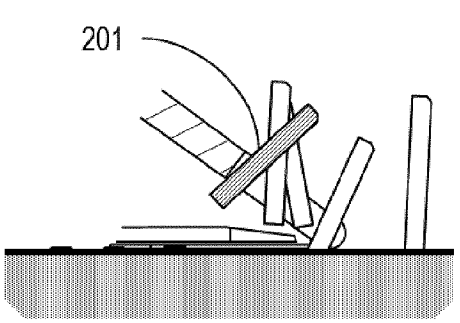
FIGS. 3A-3C schematically illustrate the clogging generating process caused by the cut hair.
Figure 3B:
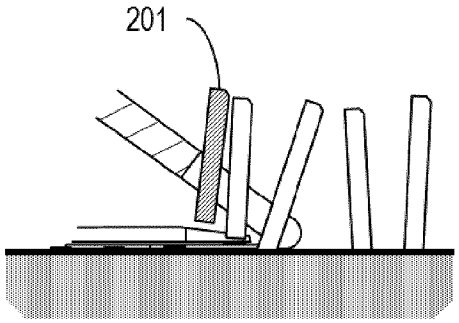
Figure 3A:
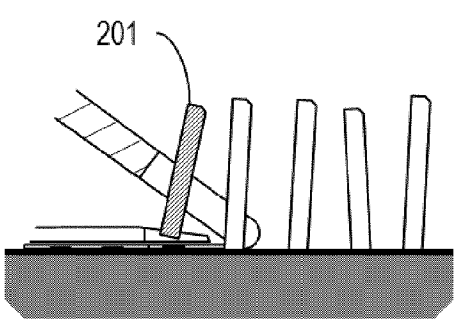

FIGS. 3A-3B schematically illustrate the clogging generating process caused by the cut hair in the shaving assembly 100. As illustrated in FIG. 3A, the hair 201 has been cut and stuck at a guard tooth slot 37. Then, with a further movement of the shaving assembly 100 against the hairs as illustrated in FIG. 3B, the previously cut and stuck hair 201 may not be easily released or pushed out of the slot just via the force generated by the subsequent hair. In other words, the applied force by the subsequent hair may not be sufficient enough to bring the stuck hair 201 out of the slot. This is because the interaction force between soft hairs is usually weak.

Then, as illustrated in FIG. 3C, with more and more cut hairs are wedged in the slot, a clogging is finally formed to close the slot. As such, even with a further movement of the shaving assembly against the hairs, only short hairs may still reach the moving teeth 21, while long hairs can no longer be received into the slot to reach the cutting position of the moving teeth 21. As such, the user must stop the shaving and clean the wedged hairs.

Figure 4:
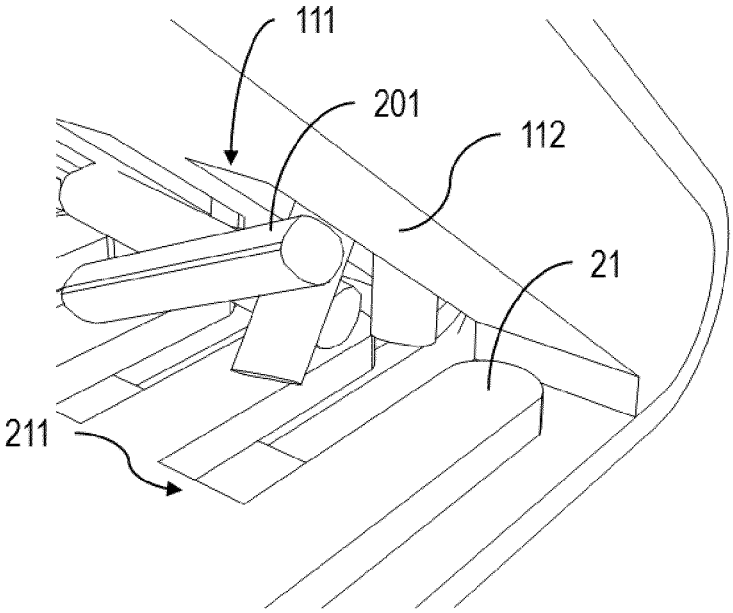
FIG. 4 schematically shows an internal view of the shaving assembly of FIG. 1C with hair clogging formed.

FIG. 4 schematically shows an internal view of the shaving assembly with the formed hair clogging. As shown, in some circumstances, the cut hair 201 may not be able to position itself properly. Rather, it may fall over to cross two neighboring moving teeth 21 in a substantially horizontal direction. This would even worsen the clogging.

In view of the forgoing, according to various embodiments of the present disclosure, the shaving assembly 100 as shown in FIGS. 1A-4 is further equipped with an anti-clogging blocking member 40. The blocking member 40 extends between the moving tooth 21 and the supporting arm 1 in the second direction Z that is substantially perpendicular to the flat contact surface 31. The blocking member 40 may facilitate hair 201 being released from the guard tooth slot 37 when the guard tooth slot 37 is moved against the hair 201.

Now various embodiments of the shaving assembly 100 with the blocking element 40 will be described with reference to FIGS. 5-8C.

In some embodiments, the blocking member 40 can be integrally formed with the moving tooth 21 as an extension of the moving tooth 21. In this case, the blocking member 40 may be made from same material as that of the moving tooth 21. In other embodiments, the blocking member 40 can be made from, for example, plastic to reduce the overall cost and weight.

Figure 5:
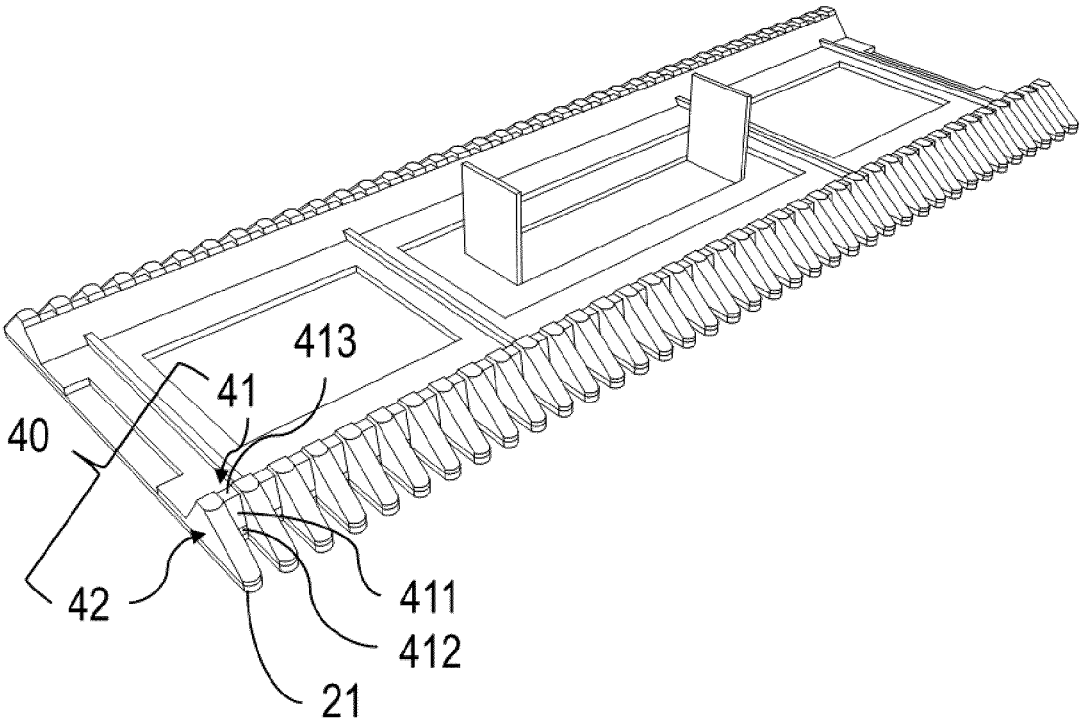
FIG. 5 illustrates a perspective of a blocking member attached on a cutting element, in accordance with an embodiment of the present disclosure.

FIG. 5 shows a perspective view of the blocking element 40 attached to the moving teeth 21. As shown, in some embodiments, the blocking member 40 may comprise a first blocking part 41. The first blocking part 41 extends between the moving tooth 21 and the supporting arm 1 in the second direction Z and comprises a surface 411 facing the guard tooth slot 37.

When the guard tooth slot 37 is moved against the hair, the blocking part 41 may apply an additional force via the surface 411 to push the cut hair 201 out of the guard tooth slot. In this case, the release of the stuck hair no longer just relies on the force applied by the subsequent hair as discussed above. As such, the hair 201 can be easily released from the slots 37.

As shown in FIG. 5, in some embodiments, first blocking part 41 has two ends 412 and 413 opposite to one another. The end 412 can be connected to a root 211 associated with the moving tooth 21, and the opposite end 413 can be separated from an inner wall of the supporting arm 1 by a first distance (not shown). That is, the opposite end 413 is not directly contacted with the inner wall of the supporting arm 1. This avoids the friction between the opposite end 413 and the inner wall of the supporting arm 1 generated during the movement of the cutting element 2.

In some embodiments, the blocking member 40 may further comprise at least one second blocking part 42 which also extends between the moving tooth 21 and the supporting arm 1 in the second direction Z. The second blocking part 42 may be oriented substantially perpendicular to the first blocking part 41 to form a side wall.

Figure 6:
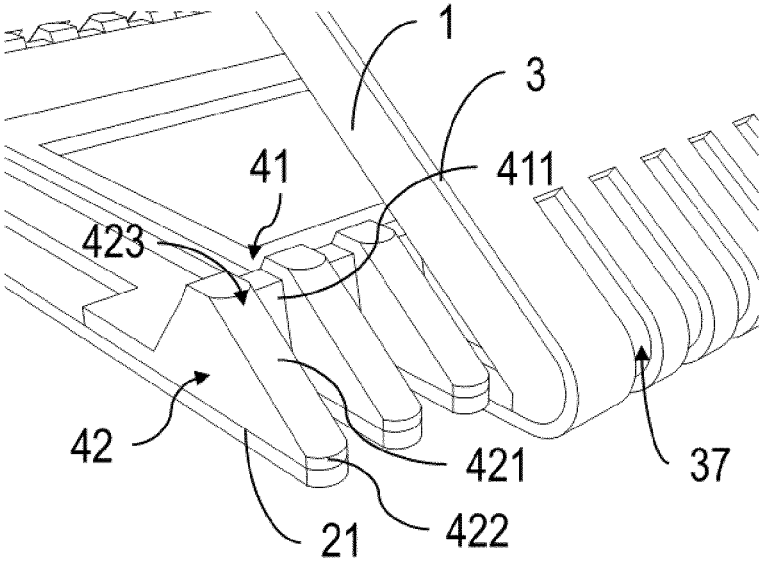
FIG. 6 illustrates a perspective of a shaving assembly having the blocking member attached on a cutting element, in accordance with an embodiment of the present disclosure.

In some embodiments as shown in FIGS. 5-6, the second blocking part 42 may comprise two second blocking parts arranged at different sides of the first blocking part 41, respectively, to form two side walls. Such side walls facilitate limiting the movement freedom of the cut hair, and especially the movement freedom along the first direction X. In this way, the cut hair can be properly manipulated by the side walls before it is pushed out of the slot by the first blocking part 41. With the help of the second blocking parts 42, the cut hair 201 crossing the slot as illustrated in FIG. 4 can be effectively avoided.

As further illustrated in FIG. 6, like the arrangement of the first blocking part 41, one end 422 of the second blocking part 42 may be connected to the moving tooth 21 and the opposite end 423 of the second blocking part 42 may be separated from an inner wall of the supporting arm 1 by a second distance h. The second distance h is clearly illustrated in FIG. 7. The second distance h likewise avoids the friction between the opposite end 423 and the inner wall of the supporting arm 1 generated during the movement of the cutting element 2.

Figure 7:
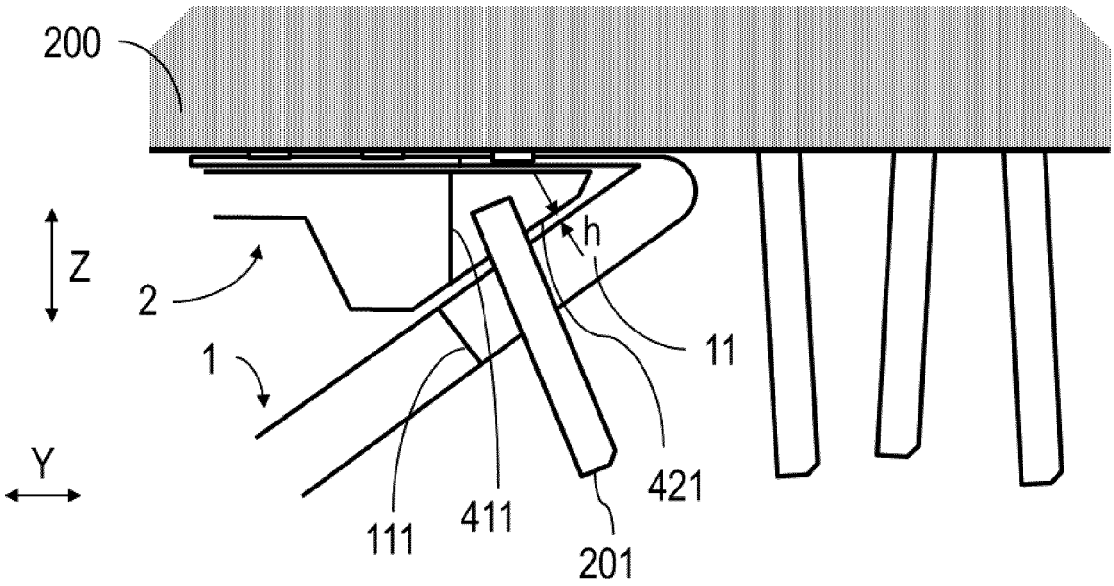
FIG. 7 illustrates a side view of the shaving assembly as shown in FIG. 6.

The opposite end 423 of the second blocking part 42 has a surface 421 matching the inner wall of the supporting arm 1, as can be seen from FIGS. 6 and 7. As illustrated in FIG. 7, the surface 421 may follow the profile of the inner wall of the supporting arm 1, so that the almost entire inner space defined by the angulated portion (when viewed from side) can be filled with the second blocking part 42, which further decreases hair clogging possibility.

In some embodiments, the surface 421 of the second blocking part 42 may extend along the inner wall of the supporting arm 1 and beyond the bottom 111 of the groove 11 of the supporting arm 1. In this way, the cut hair can be continuously manipulated by the side walls before it is completely released out of the slot.

Alternatively, in some embodiment, the blocking member 40 can be connected to the supporting arm 1 as an extension of the supporting arm 1, instead of being connected to the moving tooth 21 as illustrated in FIGS. 5-7.

Therefore, in some embodiments, the end 412 of the first blocking part 41 can be connected to the bottom 111 of the groove 11 of the supporting arm 1. Accordingly, the opposite end 413 of the first blocking part 41 can thus be separated from the moving tooth 21 by a third distance (not shown). In some embodiments, the blocking member 40 can be integrally formed with the supporting arm 1 as an extension of the supporting arm 1.

Similar to the arrangement of the blocking part 41, in some alternative embodiments, the end 422 of the second blocking part 42 can be connected to a finger 112 associated with the groove 11 of the supporting arm 1. The finger 112 is clearly illustrated in FIG. 4. Accordingly, the opposite 423 end of the second blocking part 42 can be separated from the moving tooth 21 by a fourth distance (not shown).

Figure 8C:
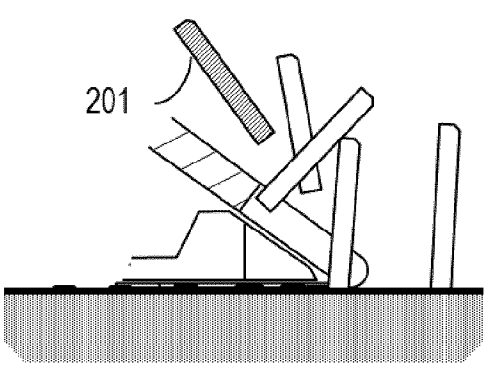
FIGS. 8A-8C schematically illustrate how the hair clogging is prevented by the blocking element as shown in FIGS. 5-7.
Figure 8B:
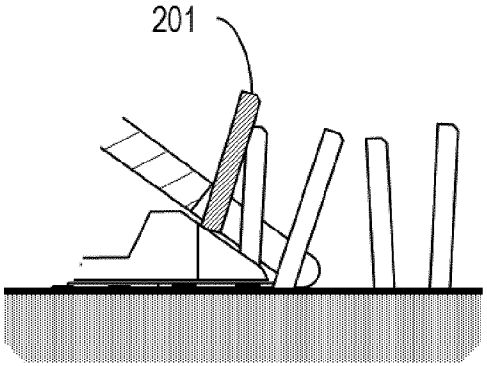
Figure 8A:
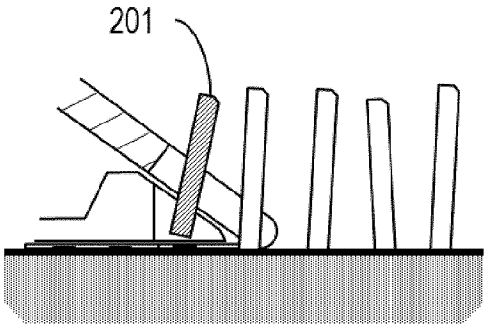

FIGS. 8A-8C schematically illustrate how the hair clogging is prevented by the blocking element. As illustrated in FIG. 8A, the hair 201 has been cut and stuck at a guard tooth slot. Then, with a further movement of the shaving assembly against the hairs as illustrated in FIG. 8B, the previously stuck hair 201 now can be pushed out of the slot by the blocking element, so that the catching of subsequent hairs will not be hindered. As illustrated in FIG. 3C, before receiving the subsequent hair to the cutting position, the previously stuck hair would always have been already pushed out. Thereby, enabling a continuous and comfortable shaving behavior, with no need to stop and clean the stuck hair in the middle of the shaving.

In sum, by means of the anti-clogging shaving assembly according to various embodiments of present disclosure, the hair clogging that may potentially occur at the slots can be effectively reduced and even eliminated, which enables comfortable and continuousness shaving. Moreover, the simple design and easy fabrication of such anti-clogging shaving assembly makes it easy to be integrated with currently available close shaving trimmers.

It is to be understood that the above detailed embodiments of the present disclosure are only to exemplify or explain principles of the present disclosure and not to limit the present disclosure. Therefore, any modifications, equivalent alternatives and improvement, etc. without departing from the spirit and scope of the present disclosure shall be comprised in the scope of protection of the present disclosure. Meanwhile, appended claims of the present disclosure aim to cover all the variations and modifications falling under the scope and boundary of the claims or equivalents of the scope and boundary.

The invention claimed is:

1. A shaving assembly comprising:

a supporting arm extending in a first direction;

a cutting element comprising at least one moving tooth arranged along the first direction;

a guard foil extending in the first direction and surrounding the cutting element, the guard foil comprising:

a contact surface and a bent part, wherein the contact surface is adapted to be in contact with skin, and the bent part extends in the first direction for fixing the guard foil on the supporting arm, and wherein an angle between the contact surface and the supporting arm is an acute angle, and a plurality of guard tooth slots formed across the contact surface and the supporting arm and arranged along the first direction, wherein each of the guard tooth slots is adapted to direct hair to the moving tooth when the guard tooth slot is moved against the hair, a blocking member extending between the moving tooth and the supporting arm in a second direction that is substantially perpendicular to the contact surface, wherein the blocking member is adapted to facilitate the hair being released from the guard tooth slot when the guard tooth slot is moved against the hair, and wherein the blocking member comprises a first blocking part extending between the moving tooth and the supporting arm in the second direction and comprising a surface facing the guard tooth slot.

2. The shaving assembly of claim 1, wherein the supporting arm comprises a plurality of grooves arranged along the first direction and corresponding to the plurality of guard tooth slots, wherein an end of each guard tooth slot extends to a bottom of a corresponding one of the grooves and an opposite end of each guard tooth slot extends to the moving tooth.

3. The shaving assembly of claim 1, wherein the first blocking part comprises a first end and a second end, wherein the first end is connected to a root associated with the moving tooth, and the second end is separated from an inner wall of the supporting arm by a distance.

4. The shaving assembly of claim 1, wherein the blocking member further comprises at least one second blocking part extending between the moving tooth and the supporting arm in the second direction.

5. The shaving assembly of claim 4, wherein the at least one second blocking part comprises two second blocking parts arranged at different sides of the first blocking part.

6. The shaving assembly of claim 4, wherein the second blocking part comprises a first end and a second end, wherein the first end is connected to the moving tooth and the second end of the second blocking part is separated from an inner wall of the supporting arm by a distance.

7. The shaving assembly of claim 6, wherein the second end of the second blocking part has a surface matching with an inner wall of the supporting arm.

8. The shaving assembly of claim 7, wherein the surface of the second end of the second blocking part extends along the inner wall of the supporting arm and beyond a bottom of a groove of the supporting arm, each groove corresponding to each guard tooth slot.

9. The shaving assembly of claim 4, wherein the second blocking part comprises a first end and a second end, wherein the first end is connected to a finger associated with each of a plurality of grooves of the supporting arm, each groove corresponding to each guard tooth slot, and the second end is separated from the moving tooth by a distance.

10. The shaving assembly of claim 1, wherein the first blocking part comprises a first end and a second end, wherein the first end is connected to a bottom of each of a plurality of grooves of the supporting arm, each groove corresponding to each guard tooth slot, and the second end is separated from the moving tooth by a distance.

11. The shaving assembly of claim 1, wherein the blocking member is integrally formed with the moving tooth.

12. The shaving assembly of claim 1, wherein the blocking member is integrally formed with the supporting arm.

* * * * *